US009689402B2

(12) United States Patent
Elebiary et al.

(10) Patent No.: US 9,689,402 B2
(45) Date of Patent: Jun. 27, 2017

(54) CENTRIFUGAL PUMP IMPELLOR WITH NOVEL BALANCING HOLES THAT IMPROVE PUMP EFFICIENCY

(71) Applicant: Flowserve Management Company, Irving, TX (US)

(72) Inventors: Kariem Elebiary, South Pasadena, CA (US); Scott Judge, Bethlehem, PA (US); Edouard Morlac, Saint Marcel (FR); Mark O'Sullivan, Phillipsburg, NJ (US)

(73) Assignee: Flowserve Management Company, Irving, TX (US)

( * ) Notice: Subject to any disclaimer, the term of this patent is extended or adjusted under 35 U.S.C. 154(b) by 596 days.

(21) Appl. No.: 14/220,169

(22) Filed: Mar. 20, 2014

(65) Prior Publication Data

US 2015/0267711 A1 Sep. 24, 2015

(51) Int. Cl.
*F04D 29/22* (2006.01)
*F04D 29/40* (2006.01)

(52) U.S. Cl.
CPC ..... *F04D 29/2266* (2013.01); *F04D 29/40* (2013.01)

(58) Field of Classification Search
CPC ..... F04D 29/2266; F04D 29/40
USPC ... 415/104, 105, 106, 54.1, 58.2, 58.4, 58.5; 416/181, 231 R
See application file for complete search history.

(56) References Cited

U.S. PATENT DOCUMENTS 2,008,308 A * 7/1935 Jacobsen ..... F04D 9/02 415/104
2,658,455 A * 11/1953 Seinfeld ..... F04D 29/2211 415/106
3,213,794 A * 10/1965 Adams ..... F04C 19/00 416/181
4,872,806 A * 10/1989 Yamada ..... F04D 29/188 415/104
4,890,980 A * 1/1990 Heald ..... F04D 29/2266 416/181
5,019,136 A * 5/1991 Elonen ..... F04D 9/003 366/157.1
5,106,263 A * 4/1992 Irie ..... F04D 29/2255 415/106
5,156,522 A 10/1992 Tessier
(Continued)

FOREIGN PATENT DOCUMENTS

JP 2006125348 A 5/2006

*Primary Examiner* — William McCalister
(74) *Attorney, Agent, or Firm* — Maine Cernota & Rardin

(57) ABSTRACT

A centrifugal pump impellor includes balancing holes that reduce axial thrust while minimizing the loss of pump efficiency. In one general aspect, the balancing holes penetrate the rear shroud between the blades, and are angled in both axial and rotational directions so as to direct the leakage fluid approximately parallel to the primary process fluid, so that it causes minimal interference with the primary fluid flow. In a second general aspect, the balancing holes extend from the rear cavity within the impellor blades and through the leading edges of the blades, thereby entering the primary flow in locations where the process fluid is almost static relative to the blades. This minimizes the impact on the flow of the process fluid past the blades, and thereby minimizes the loss of pump efficiency caused by the balance holes. In embodiments, each blade leading edge includes a plurality of balancing hole outlets.

4 Claims, 15 Drawing Sheets

(56) References Cited

U.S. PATENT DOCUMENTS

| | | | | | |
|---|---|---|---|---|---|
| 5,167,678 | A * | 12/1992 | Elonen | F04D 9/003 | 415/169.1 |
| 5,224,821 | A | 7/1993 | Ozawa | | |
| 5,542,817 | A * | 8/1996 | Brandt | F04D 29/2266 | 415/106 |
| 5,628,616 | A * | 5/1997 | Lee | F04D 29/2288 | 415/199.1 |
| 5,924,842 | A * | 7/1999 | Beyer | F03B 3/125 | 415/115 |
| 6,019,576 | A * | 2/2000 | Thut | F04D 7/065 | 415/200 |
| 6,468,039 | B1 * | 10/2002 | Lehman | F04D 7/065 | 415/200 |
| 6,893,207 | B2 * | 5/2005 | Kao | F04D 29/2288 | 415/58.2 |
| 7,326,029 | B2 | 2/2008 | Ahlroth et al. | | |
| 7,377,036 | B2 * | 5/2008 | Johnson | F23R 3/286 | 29/401.1 |
| 7,857,577 | B2 * | 12/2010 | Eslinger | F03G 7/00 | 415/1 |
| 2006/0263200 | A1 * | 11/2006 | Ahlroth | F04D 29/2266 | 415/58.2 |
| 2008/0031725 | A1 * | 2/2008 | LaRose | A61M 1/101 | 415/104 |

* cited by examiner

CENTRIFUGAL PUMP IMPELLOR WITH NOVEL BALANCING HOLES THAT IMPROVE PUMP EFFICIENCY

FIELD OF THE INVENTION

The invention relates to centrifugal pumps, and more particularly, to centrifugal pump impellors that include balancing holes to reduce axial thrust.

BACKGROUND OF THE INVENTION

Centrifugal pumps are the most widely used pumps in the world. While there are many variations and configurations, with reference to FIG. 1 all such pumps 100 include an impellor 106 mounted on a shaft 108 that rotates the impellor 106 continuously within a housing 116. The impellor 106 includes a plurality of "blades" or "vanes" 110 extending outward from a hub and a central "eye" of the impellor. Process fluid 102 entering through an inlet 118 to the eye is caused to rotate by the impellor blades 110, and is driven by centrifugal force toward the perimeter of the impellor 106, which is in fluid communication with an outlet 104 through which the process fluid exits the pump 100.

FIG. 1 illustrates a single-stage centrifugal pump. However the discussion herein and the disclosure of the invention infra will be understood by one of skill in the art to also apply to stages of a multi-stage pump, unless the context requires otherwise.

Impellors 106 vary in the number and shape of the blades 110. For some impellors 106 the blades 110 are free-standing. However, for larger pumps it is often desirable to include a rear shroud 112, and possibly also a front shroud 114, which support the blades 110 and also reduce leakage around the blades. An impellor 106 having free-standing blades is called an "open" impellor. An impellor 106 having only a rear shroud 112 is called "semi-open" or "semi-closed" impellor 106, while an impellor having both rear 112 and front 114 shrouds is referred to as a "closed" impellor. FIG. 1 is a cut-away perspective view of a centrifugal pump 100 having a closed impellor 106.

FIG. 2 is a front perspective view of a closed impellor 106. The leading edges 202 of the blades 110 can be seen through the eye near the hub 200 of the impellor 106. The trailing edges 204 of the blades 110 are visible between the shrouds 112, 114 near the outer edge of the impellor 106.

FIG. 3A is a cross-sectional view of the impellor 106 of FIG. 2, enclosed within a single-stage pump housing 116. Wear rings 300, 302 inhibit process fluid from leaking into or out of a chamber 304 located behind the rear shroud 112. However, some process fluid leaks past the wear rings 300, 302 and fills a cavity 304 located behind the rear shroud 112. The fluid filling the cavity 304 is therefore sometimes referred to as "leakage" fluid. Frictional drag causes the leakage fluid in contact with the back of the rear shroud 112 to rotate approximately at the speed of the impellor 106, while the leakage fluid that is in contact with the housing 116 on the other side of the cavity 304 is almost static. Shear forces cause the leakage fluid in the center of the cavity 304 to rotate at a speed that is less than the impellor speed, so that the average rotational speed of the leakage fluid in the cavity 304 is comparable to one half of the impellor speed.

In contrast, process fluid located near the front surface of the rear shroud 112 is rotated by the blades 110 at approximately the speed of the impellor 106. The "static" pressure of the fluid in front of the rear shroud 112 is the process fluid inlet pressure, while the static pressure of the leakage fluid is comparable to the higher outlet pressure. The actual pressures are reduced in each case, because according to well-known fluid dynamic principles the pressure of a fluid is reduced in proportion to its velocity. Hence, because the leakage fluid is rotating more slowly than the fluid in front of the rear shroud 112, the actual pressure of the fluid immediately in front of the rear shroud 112 in the region of the eye is considerably lower than the actual pressure of the leakage fluid filling the cavity 304 directly behind the rear shroud 112. The result of the difference in static pressures as well as the difference in fluid rotation rates is an axial thrust applied to the impellor 106, which is labeled "F" in FIG. 3. This thrusting force must be opposed and withstood by the bearings (not shown) that support the pump shaft 108.

FIG. 3B is a cross-sectional view of two stages of a multi-stage pump. In this example, the leakage past the shaft seal 302 eventually flows from the rear cavity 304 back into the primary flow 102 entering the first stage. Each of the impellors 106, 306 is subject to axial thrust, as described above, such that the shaft bearings are subject to the combined sum of the axial thrusts of all the stages.

In many instances, it is desirable to reduce the axial thrust, so as to reduce the demands placed on the support bearings, and to prolong the life of the support bearings. With reference to FIG. 4, one approach is to include "balancing holes" 400 that penetrate the rear shroud 112 near the hub 200. The balancing holes allow leakage fluid to flow from the rear cavity 304 into the eye, thereby "balancing" the fluid pressures on either side of the rear shroud 112 and reducing or eliminating the axial thrust. FIG. 5 is a front perspective view of the central region of the impellor 106 of FIG. 4.

While balancing holes are effective in reducing axial thrust, they also inevitably cause a loss of pump efficiency. As can be seen in FIG. 4, the flow of leakage fluid 402 through the balancing holes 400 is in nearly direct opposition to the fluid flowing into the eye. Accordingly, the flow of leakage fluid significantly perturbs and interferes with the primary flow 102 of the process fluid, thereby significantly reducing the efficiency of the centrifugal pump.

What is needed, therefore, is a centrifugal pump impellor having balancing holes that reduce or eliminate axial thrust while minimizing the loss of pump efficiency.

SUMMARY OF THE INVENTION

The present invention is a centrifugal pump impellor having balancing holes that minimize disruption of the primary process fluid flow caused by the flow of leakage fluid through balance holes, thereby reducing axial thrust while at the same time minimizing the loss of pump efficiency caused by the balancing holes.

In one general aspect of the invention, the balancing holes penetrate the rear shroud between the blades 110, and are angled in both axial and rotational directions so as to direct the flow of leakage fluid in a direction that approximates the direction of the primary process fluid flow along the blades. As a result, the flow of leakage fluid causes little if any interfere with the flow of process fluid along the blades. This improves the pump efficiency as compared to similar pumps having balancing holes that are directed axially through the rear shroud.

In a second general aspect of the present invention, the balancing holes extend from the rear cavity through the rear shroud and within the impellor blades, exiting through the leading edges of the impellor blades. The leakage flow through the balance holes thereby enters the primary flow in locations where the process fluid is almost static in relation to the blades, and is not flowing along the sides of the blades. This minimizes the impact of the leakage fluid on the flow of the process fluid past the blades, and thereby minimizes the loss of pump efficiency caused by the balance holes. In fact, the leakage flow exiting the impeller vane leading edges enters the primary flow in a way that disrupts boundary layer flow along the vanes, thereby reducing flow losses and improving efficiency. In embodiments, the leading edge of each blade includes a plurality of openings through which leakage fluid emerges into the primary process fluid flow. In some of these embodiments, the openings are all connected to a single balancing hole that extends sideways through the blade and through the rear shroud to the rear cavity.

One general aspect of the present invention is an impellor suitable for use in a centrifugal pump. The impellor includes a rear shroud having a front surface, a rear surface, and a rear shroud central axis, a plurality of blades symmetrically surrounding the central axis and having rear edges fixed to the front surface of the rear shroud, the blades being configured to impart rotation to process fluid located near the rear shroud central axis, and to cause the process fluid to flow outward between the blades due to centrifugal acceleration, and at least one balancing hole penetrating the rear shroud, the balancing hole being angled such that a front end of the balancing hole penetrates the front surface of the rear shroud in a location that is radially further from the central axis than a rear end of the balancing hole that penetrates the rear surface of the rear shroud, the front end of the balancing hole being rotationally behind the rear end of the balancing hole, the balancing hole being thereby configured to direct leakage fluid emerging from its front end in a direction that is approximately parallel to a primary process fluid flow direction near the front end of the balancing hole.

Embodiments further include a hub extending forward from the rear shroud, the hub having a hub central axis that is coincident with the rear shroud central axis, the hub being mountable on a drive shaft.

Some embodiments further include a front shroud attached to front edges of the blades and having a front shroud central axis that is coincident with the rear shroud central axis.

In various embodiments, a plurality of the balancing holes is distributed symmetrically about the central axis. And in some of these embodiments the balancing holes and the blades are equal in number.

In embodiments, the front end of the balancing hole is further from the rear shroud central axis than leading edges of the blades, and the rear end of the balancing hole is closer to the rear shroud central axis than the leading edges of the blades.

And certain embodiments further include a housing within which the impellor is contained and rotated, the housing including an inlet that directs process fluid toward a central region of the rear shroud, and an outlet that collects and emits process fluid near an outer perimeter of the impellor, a rear cavity being formed between the housing and a rear surface of the rear shroud proximal to the rear shroud central axis, the balancing hole providing fluid communication between the rear cavity and the front surface of the rear shroud.

Another general aspect of the present invention is an impellor suitable for use in a centrifugal pump. The impellor includes a rear shroud having a front surface, a rear surface, and a rear shroud central axis, a plurality of blades symmetrically surrounding the central axis and having rear edges fixed to the front surface of the rear shroud, the blades being configured to impart rotation to process fluid located near the rear shroud central axis, and to cause the process fluid to flow outward between the blades due to centrifugal acceleration, and at least one balancing hole penetrating the rear shroud and continuing within one of the blades, the balancing hole having a rear end penetrating the rear shroud and at least one front outlet penetrating a leading edge of the blade, the balancing hole being thereby configured to direct leakage fluid from a rear surface of the rear shroud through the front outlet in the leading edge of the blade.

Embodiments further include a substantially cylindrical hub extending forward from the rear shroud, the hub having a hub central axis that is coincident with the rear shroud central axis, the hub being mountable on a drive shaft;

Various embodiments further include a front shroud attached to front edges of the blades and having a front shroud central axis that is coincident with the rear shroud central axis.

In one embodiments, the balancing holes and the blades are equal in number, and each balancing hole penetrates through a corresponding blade. In other embodiments, the balancing hole includes a plurality of front outlets in the leading edge of the blade.

And various embodiments further include a housing within which the impellor is contained and rotated, the housing including an inlet that directs process fluid toward a central region of the rear shroud, and an outlet that collects and emits process fluid near an outer perimeter of the impellor, a rear cavity being formed between the housing and the rear surface of the rear shroud, the balancing hole providing fluid communication between the rear cavity and the leading edge of the blade.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present invention is a centrifugal pump impellor having balancing holes that minimize disruption of the process fluid flow along the blades due to the flow of leakage fluid through balancing holes, thereby reducing axial thrust while minimizing the loss of pump efficiency caused by the balancing holes.

Figure 1:
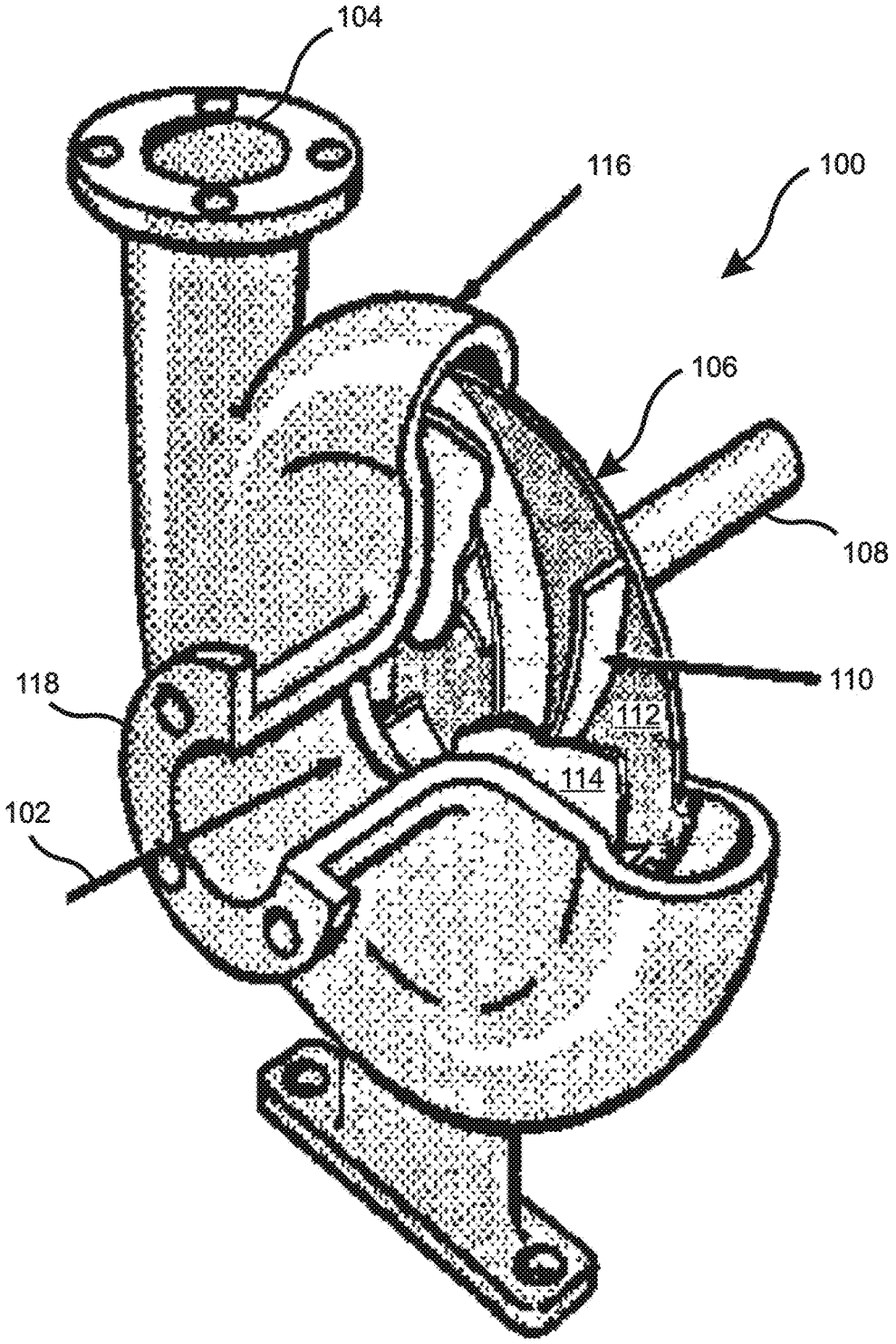
Figure 1 Prior Art
FIG. 1 is a cutaway perspective view of a centrifugal pump of the prior art.
Figure 2:
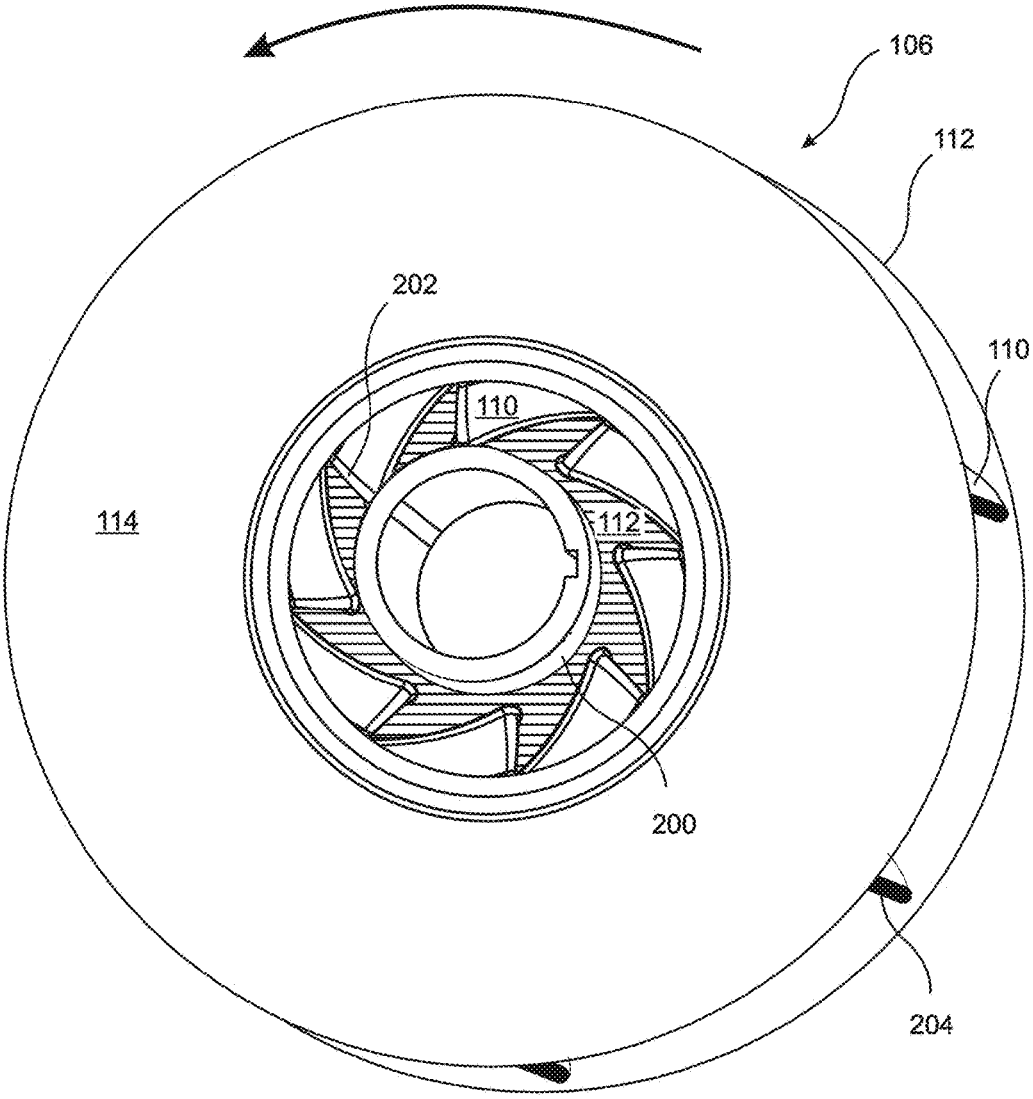
Figure 2 Prior Art
FIG. 2 is a front perspective view of a closed impellor of the prior art.
Figure 3A:
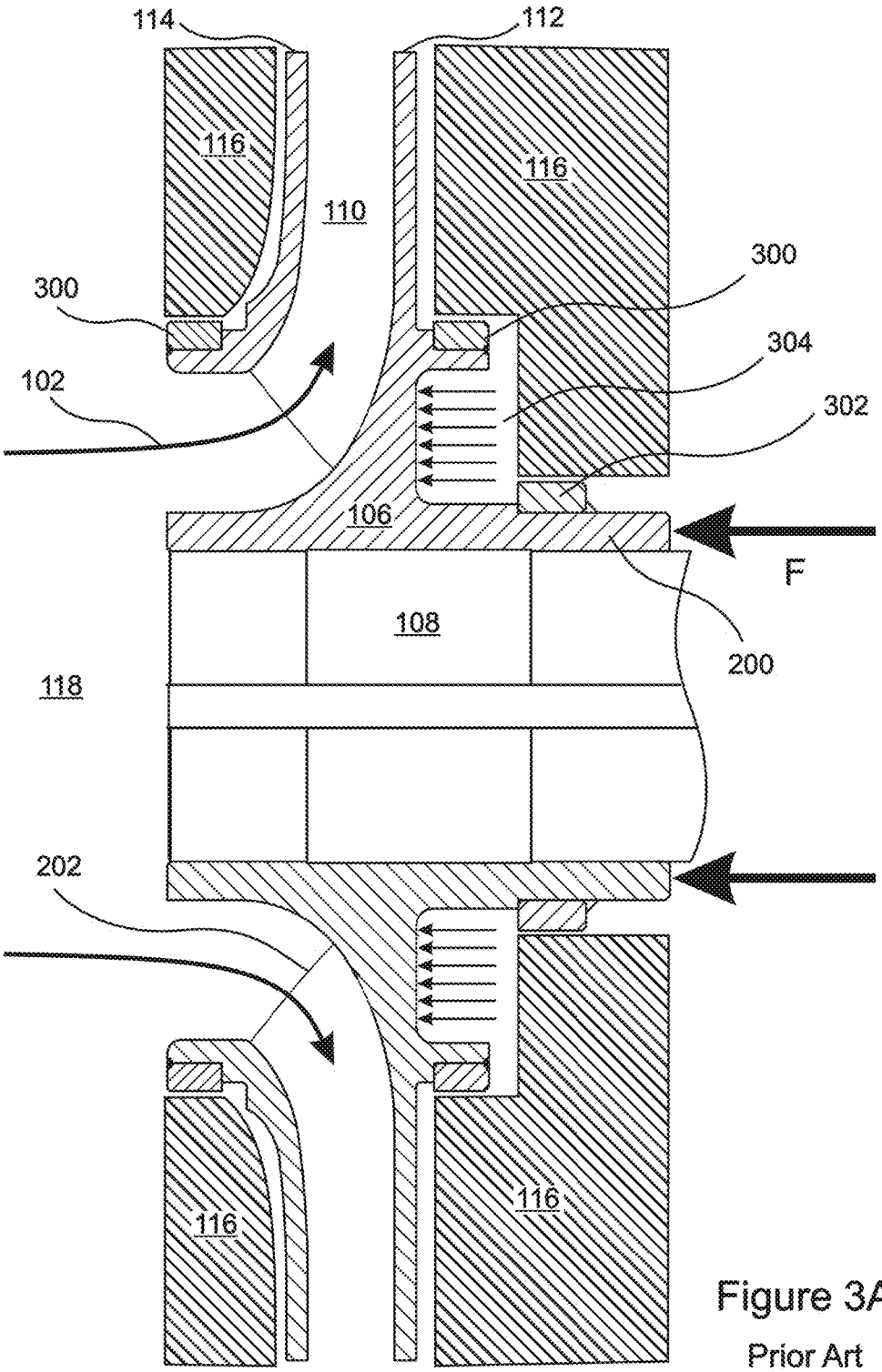
Figure 3A Prior Art
FIG. 3A is a cross-sectional view of the impellor of FIG. 2 contained within a housing of a single stage pump.
Figure 3B:
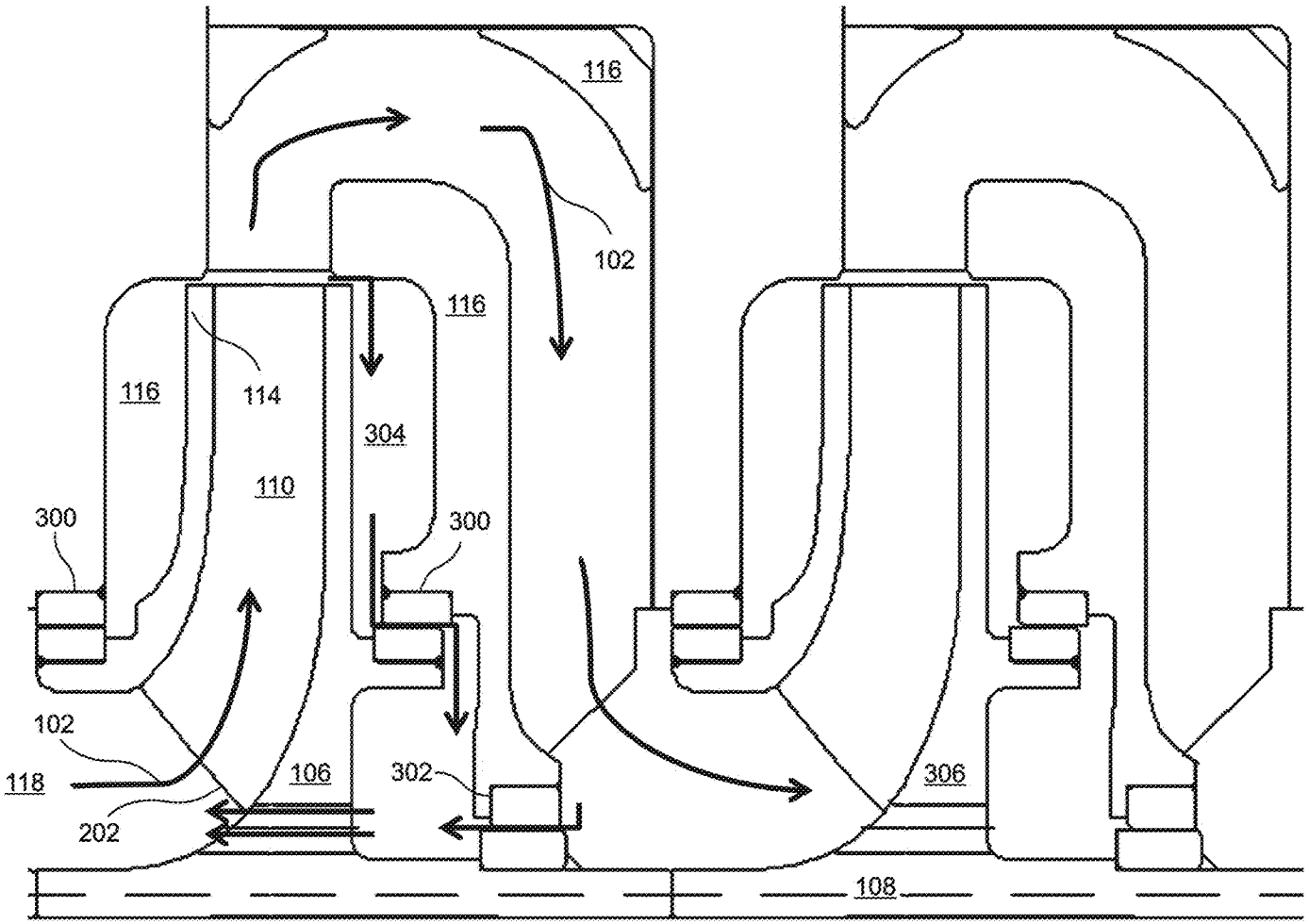
Figure 3B (Prior Art)
FIG. 3B is a cross-sectional view of impellor in two consecutive stages of a multi-stage pump.
Figure 4:
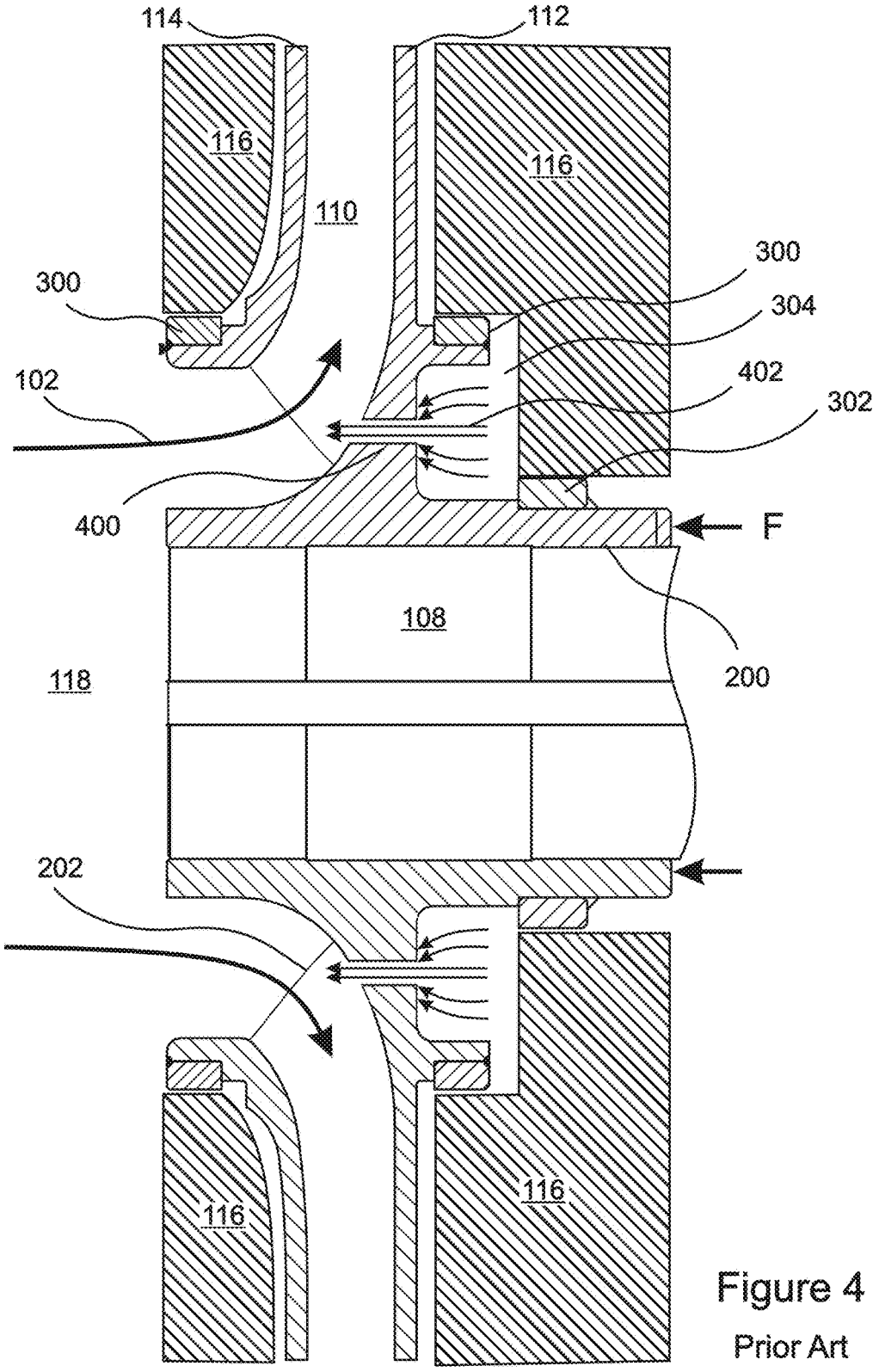
Figure 4 Prior Art
FIG. 4 is a cross-sectional view of an impellor similar to FIG. 3, but including axial balancing holes of the prior art.
Figure 5:
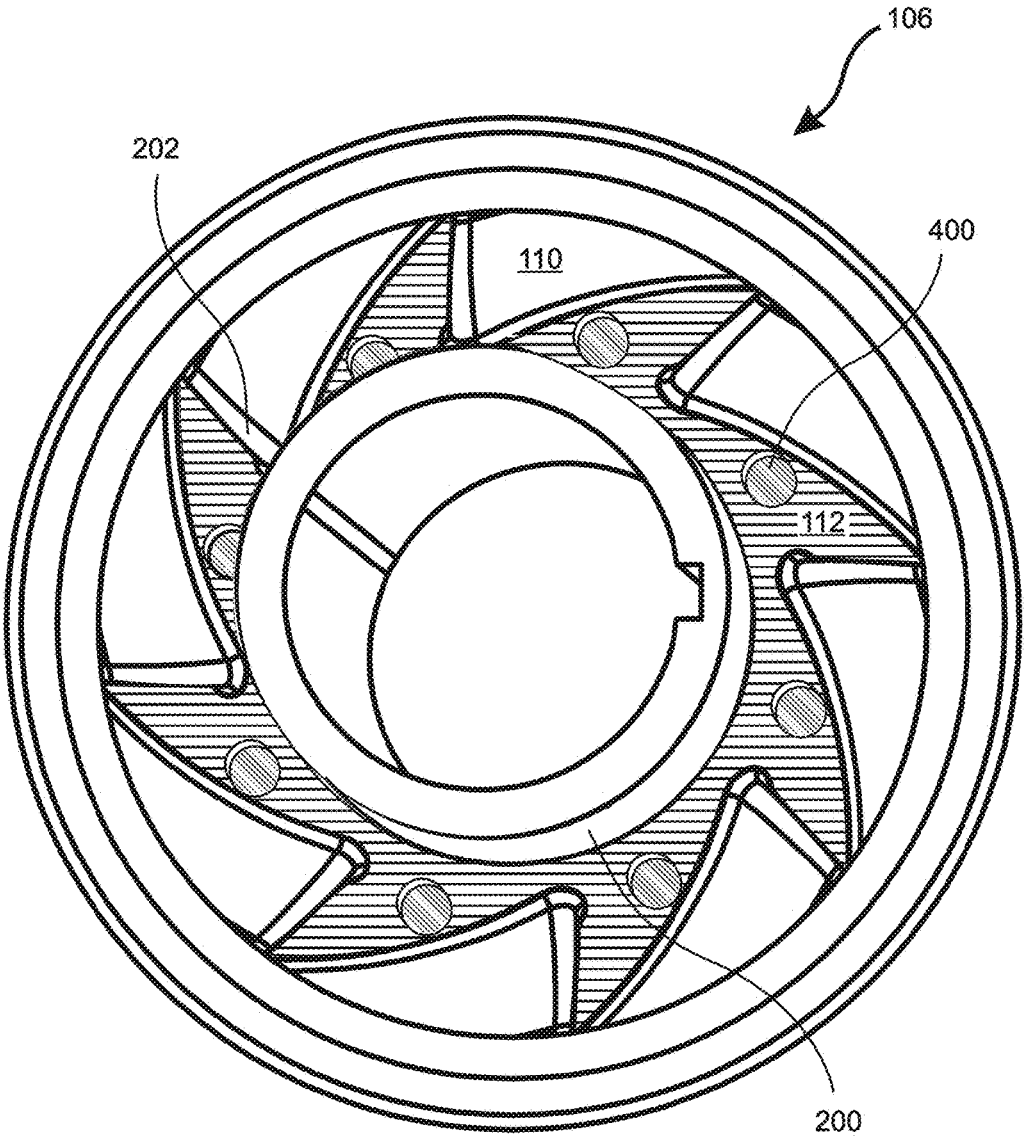
Figure 5 Prior Art
FIG. 5 is a front perspective view of the closed impellor of FIG. 4.
Figure 6:
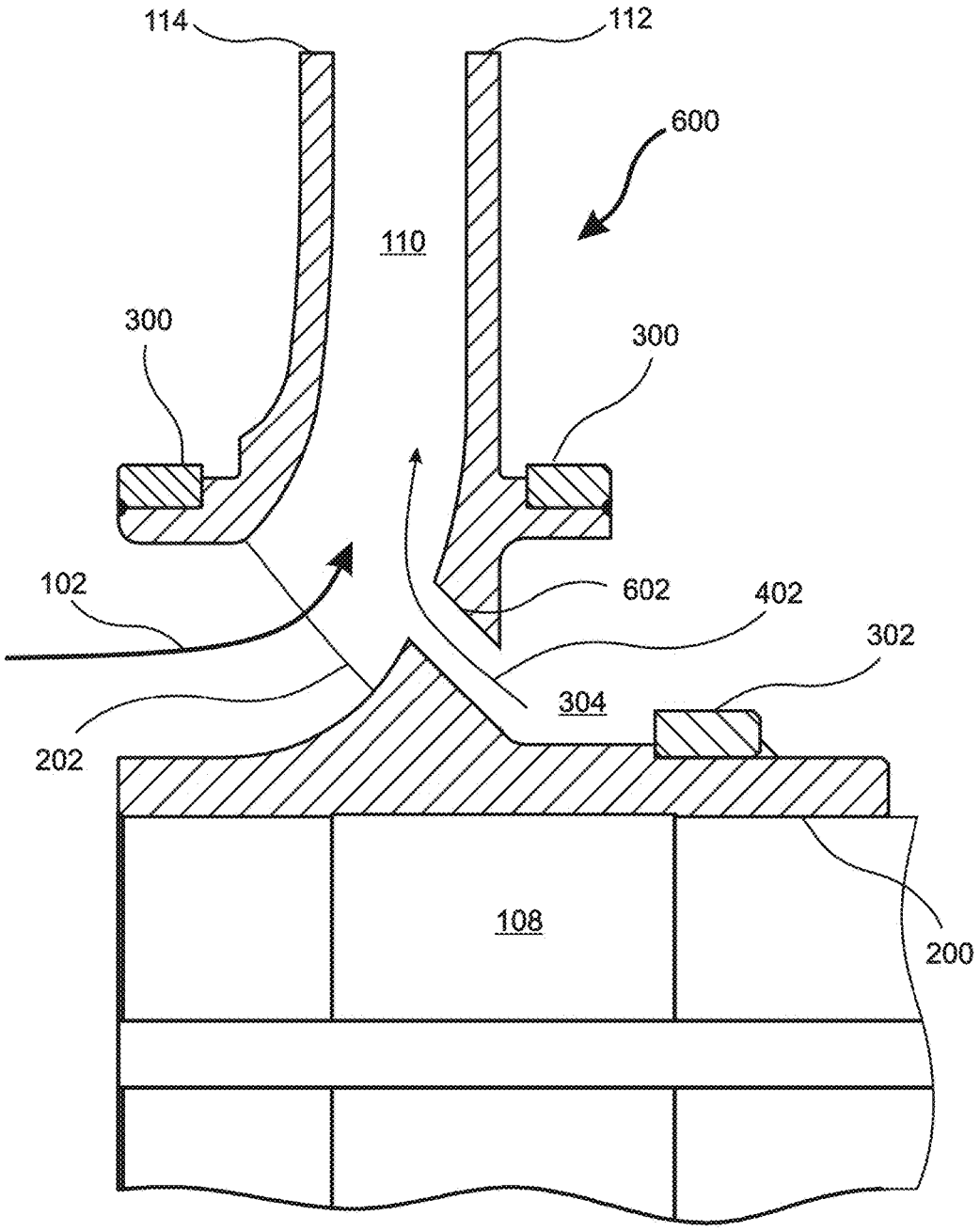
FIG. 6 is a cross sectional view of an impellor in an embodiment of the present invention that directs leakage flow through the rear shroud between the blades in a direction that is approximately parallel to the primary flow.

With reference to FIG. 6, in one general aspect of the invention the balancing holes 602 penetrate the rear shroud 112 between the blades 110 and are angled in both axial and rotational directions so as to direct the flow of leakage fluid 402 through the balancing holes 602 in a direction that is approximately parallel to the primary flow 102 of process fluid along the blades 110. As a result, the flow 102 of the process fluid along the blades 110 is only minimally disturbed, if at all, by the flow of leakage fluid 402 from the rear cavity 304. This improves the pump efficiency as compared to conventional pumps with axially directed balancing holes 400 through which leakage fluid flows in a direction almost directly opposed to the primary flow 102 of process fluid. Note that only the top half of the impellor 600 and shaft 202 are shown in FIG. 6.

Figure 7:
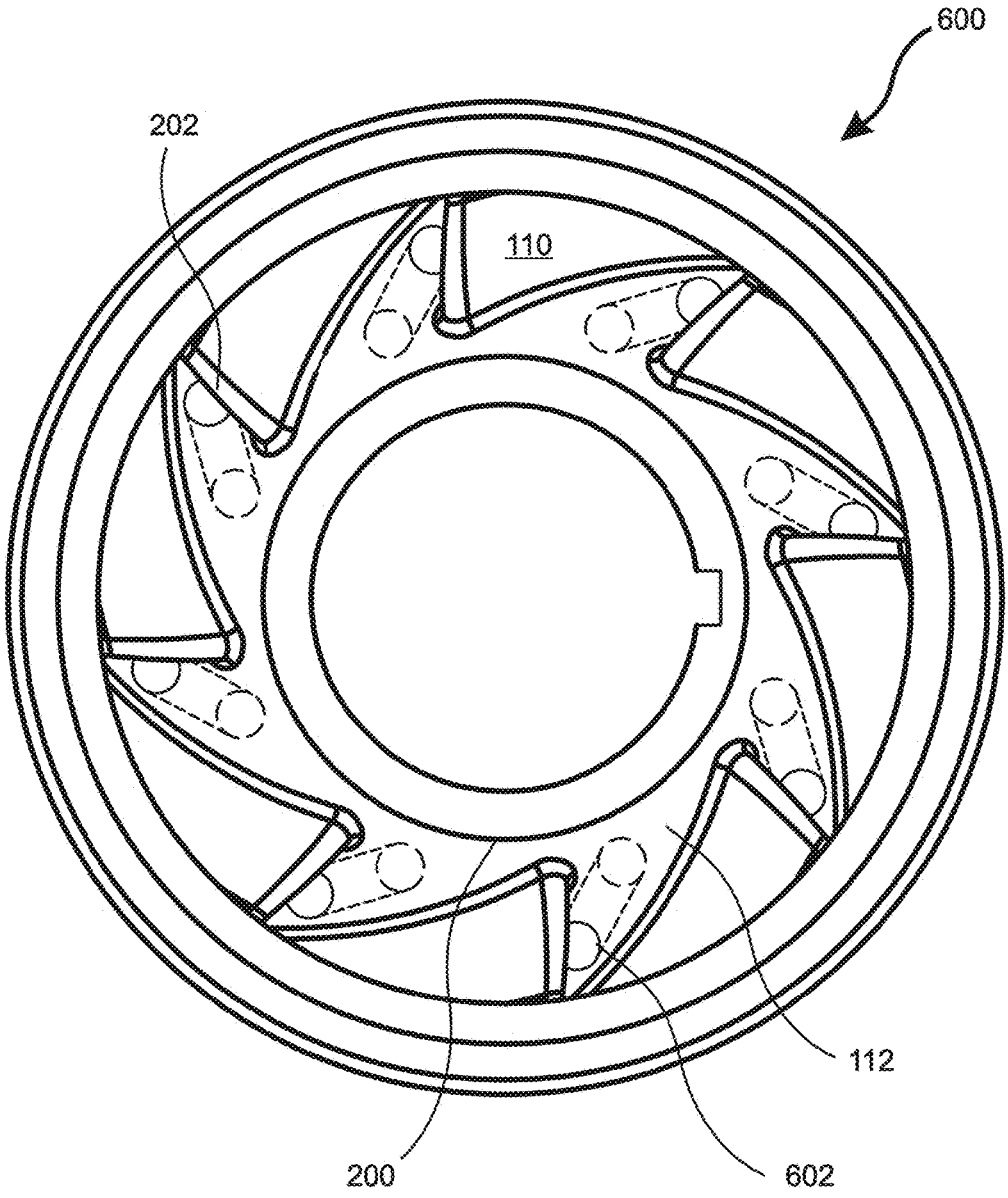
FIG. 7 is a front view of the inlet region of the impellor of FIG. 6.

FIG. 7 is a front view of the impellor 600 of FIG. 6. The front openings of the balancing holes 602 are shown as solid circles, and the rear openings of the balancing holes 602 into the rear cavity 304 are shown as dashed circles, with dashed lines showing the passage through the rear shroud 112 there between.

Figure 8:
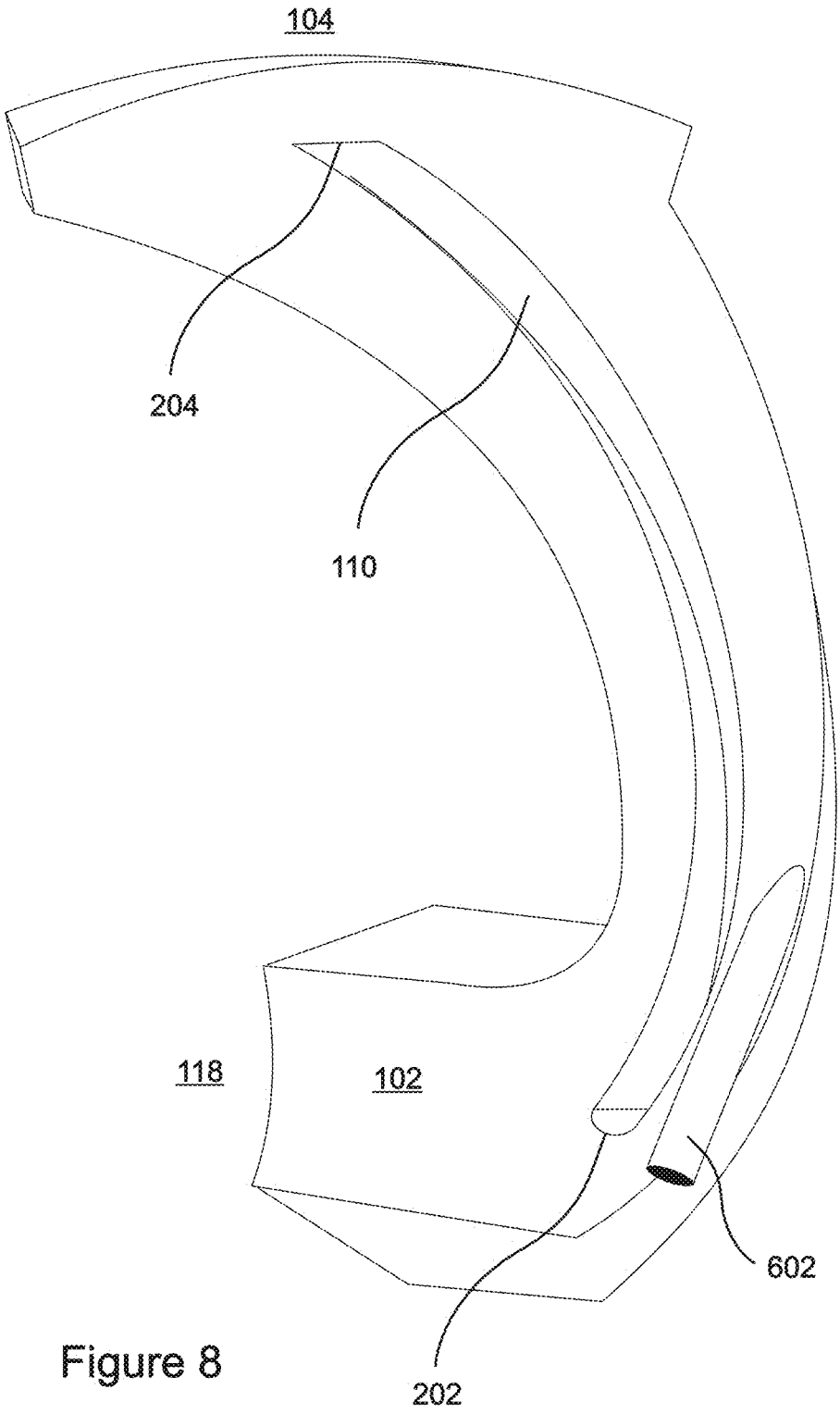
FIG. 8 is a perspective diagram depicting the fluid-filled space surrounding a blade in the impellor of FIG. 7, and showing the relative orientation of a balancing hole.

FIG. 8 is a three-dimensional perspective view of the fluid-occupied space surrounding a blade 110 of the impellor 600 of FIG. 7. It can be seen that the balancing hole 602 enters this space approximately parallel to the surface of the blade 110, and hence to the direction of primary fluid flow along the blade 110.

Figure 9:
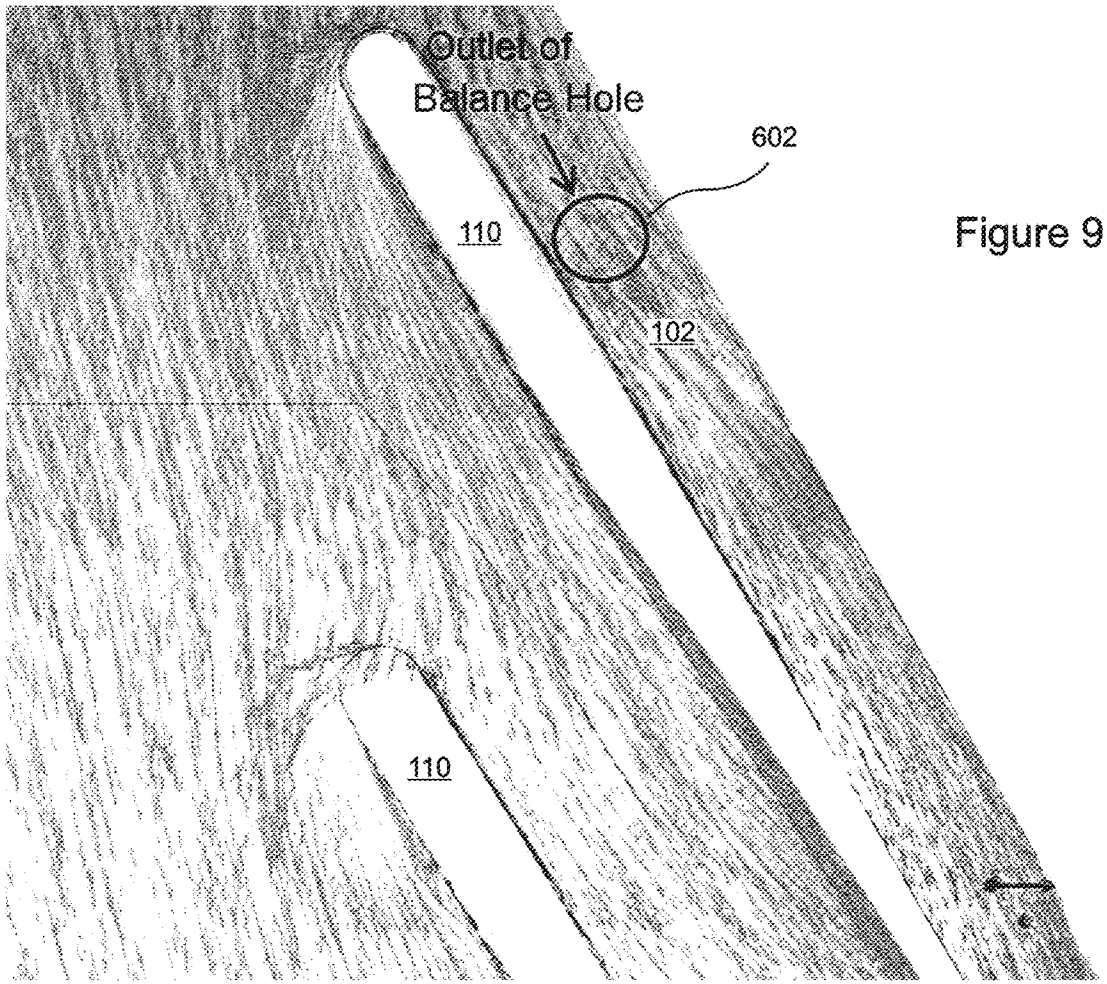
FIG. 9 is a cross-sectional view of the fluid-containing regions surrounding blades of the impellor of FIG. 8, showing simulated flow directions and velocities.

FIG. 9 is a map of process fluid flowing past blades of the impellor of FIG. 7, as calculated in a simulation. It can be seen that the entry of leakage fluid into the flow through the balancing hole 602 causes little if any perturbation of the flow of process fluid 102 past the blade 110.

Figure 10:
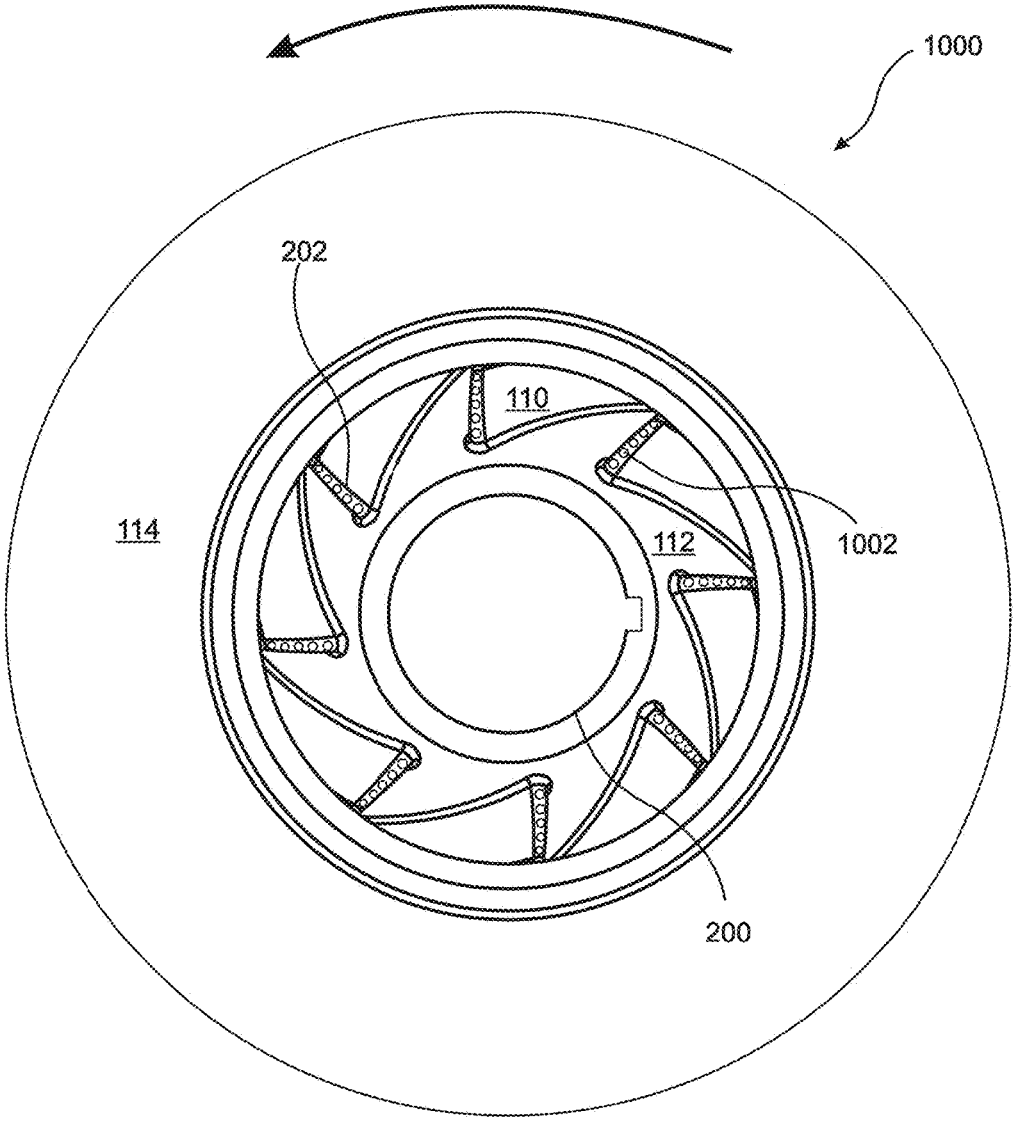
FIG. 10 is a front view of an impellor according to an embodiment of the present invention that includes balancing holes with outlets penetrating the leading edges of the blades.
Figure 11:
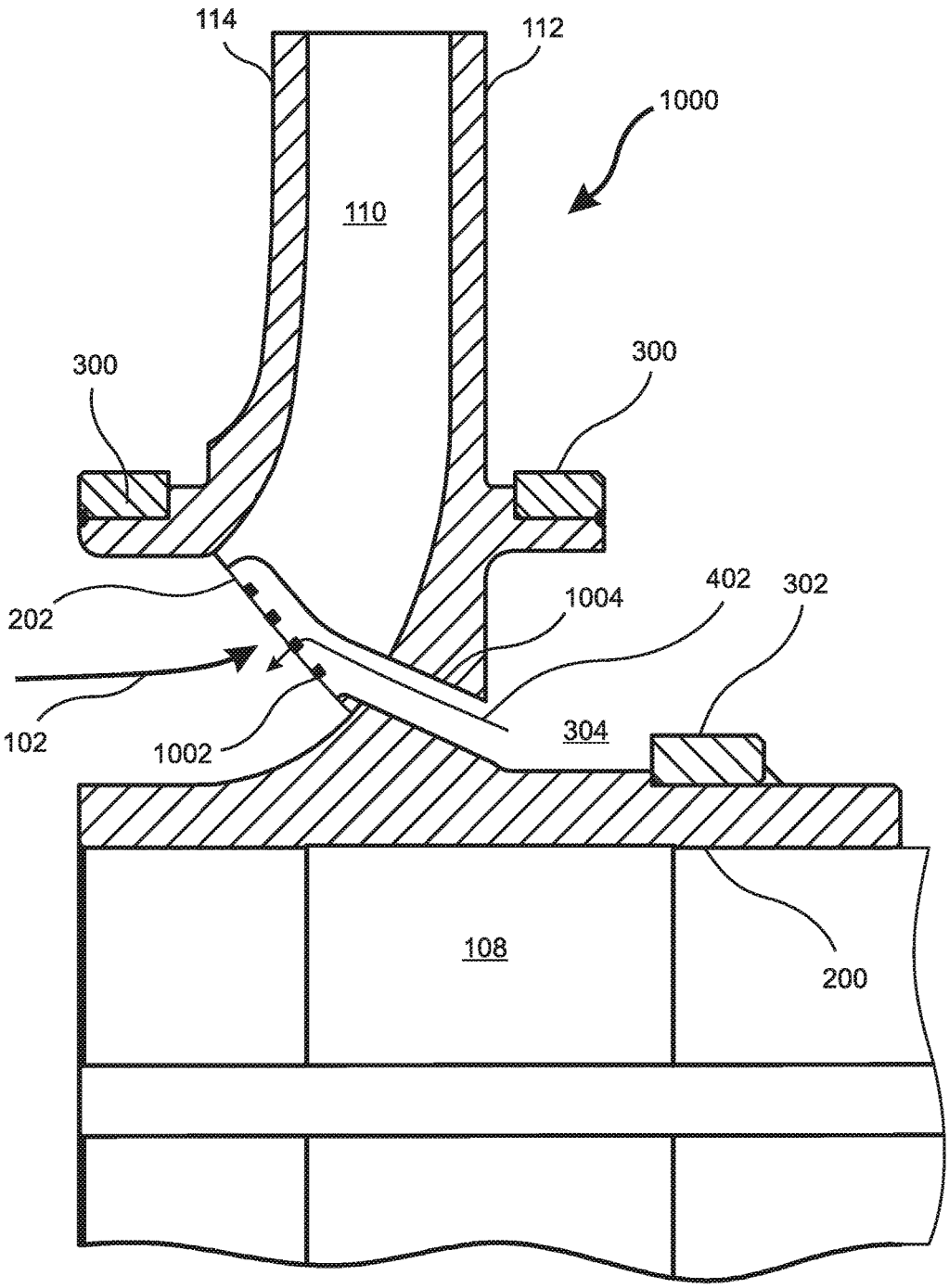
FIG. 11 is a cross-sectional view of the impellor of FIG. 10.

With reference to FIGS. 10 and 11, in another general aspect of the invention the balancing holes 1004 penetrate the rear shroud 112, extend within the blades 110, and terminate in openings 1002 in the leading edges 202 of the blades 110. As the leading edge 202 of a blade passes through the process fluid, the primary flow of the process fluid is divided about the leading edge 202, so that some process fluid flows over a leading surface of the blade 110 and some process fluid flows over a trailing surface of the blade 110. This causes the process fluid to be nearly static with respect to the blade 110 in the region immediately in front of the leading edge 202. In the embodiment of FIGS. 10 and 11, the leakage fluid 402 flows into this static region. As a result, the flow 102 of the process fluid along the surfaces of the blades 110 is only minimally disturbed, if at all, by the flow of leakage fluid 402 from the rear cavity 304. This improves the pump efficiency as compared to conventional pumps with axially directed balancing holes. Note that only the top half of the impellor 1000 and shaft 108 are shown in FIG. 11.

FIG. 10 is a front view of the impellor 1000 of FIG. 11. The front openings 1002 of the balancing holes 1004 are shown as small circles on the leading edges 202 of the blades 110 in FIG. 10. In the embodiment of FIGS. 10 and 11, each balancing hole 1004 terminates in a plurality of outlets 1002 in the leading edge 202 of a blade 110. In similar embodiments, each balancing hole 1004 terminates in a single outlet 1002 in the leading edge 202 of a blade 110.

Figure 12:
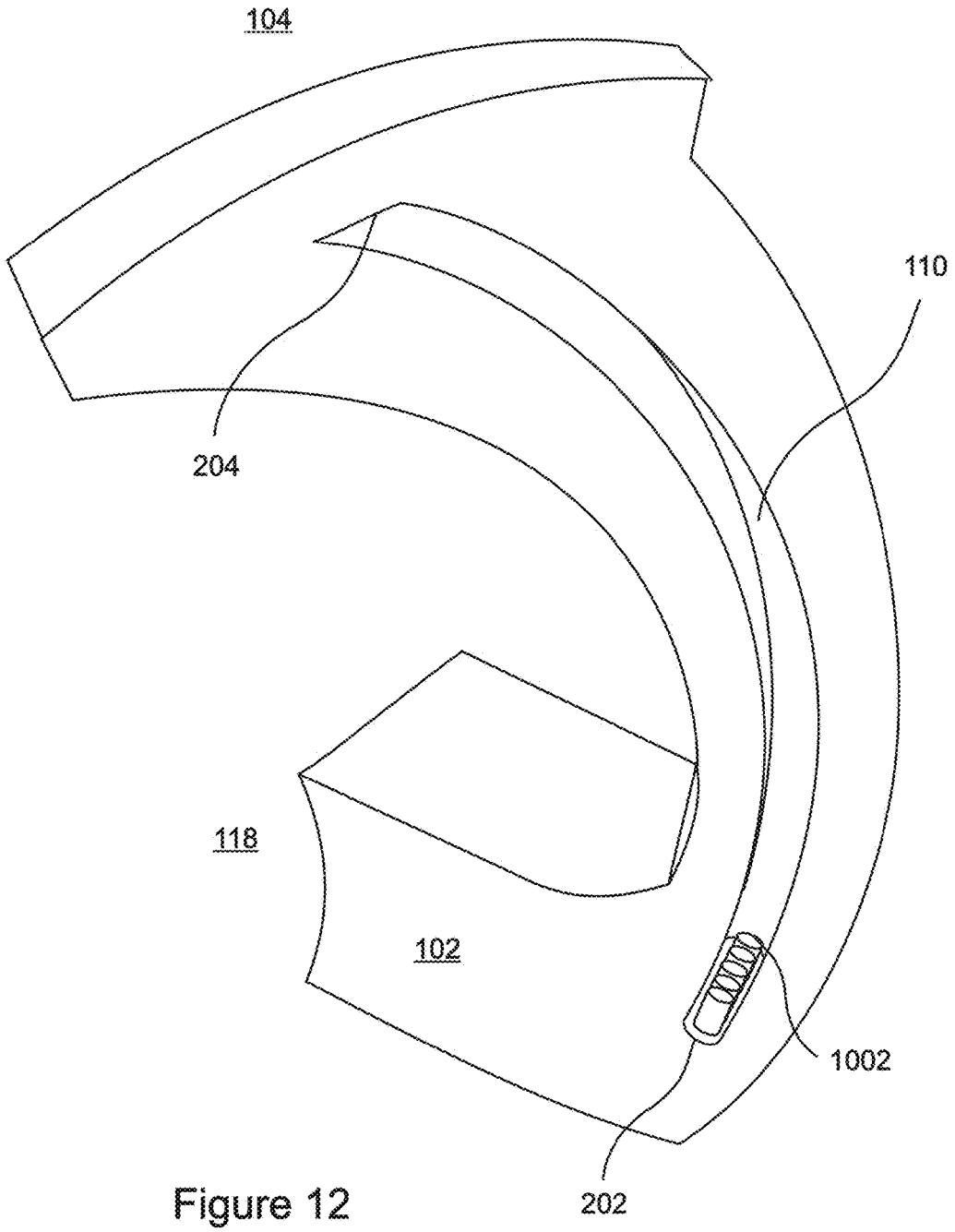
FIG. 12 is a perspective diagram that depicts the fluid-filled space surrounding a blade in the impellor of FIG. 11, and showing the positions and orientation of the balancing hole outlets.

FIG. 12 is a three-dimensional perspective view of the fluid-occupied space surrounding a blade 110 of the impellor 1000 of FIG. 11. The outlets 1002 of the balancing hole 1004 can be seen near the bottom right corner of the figure.

Figure 13:
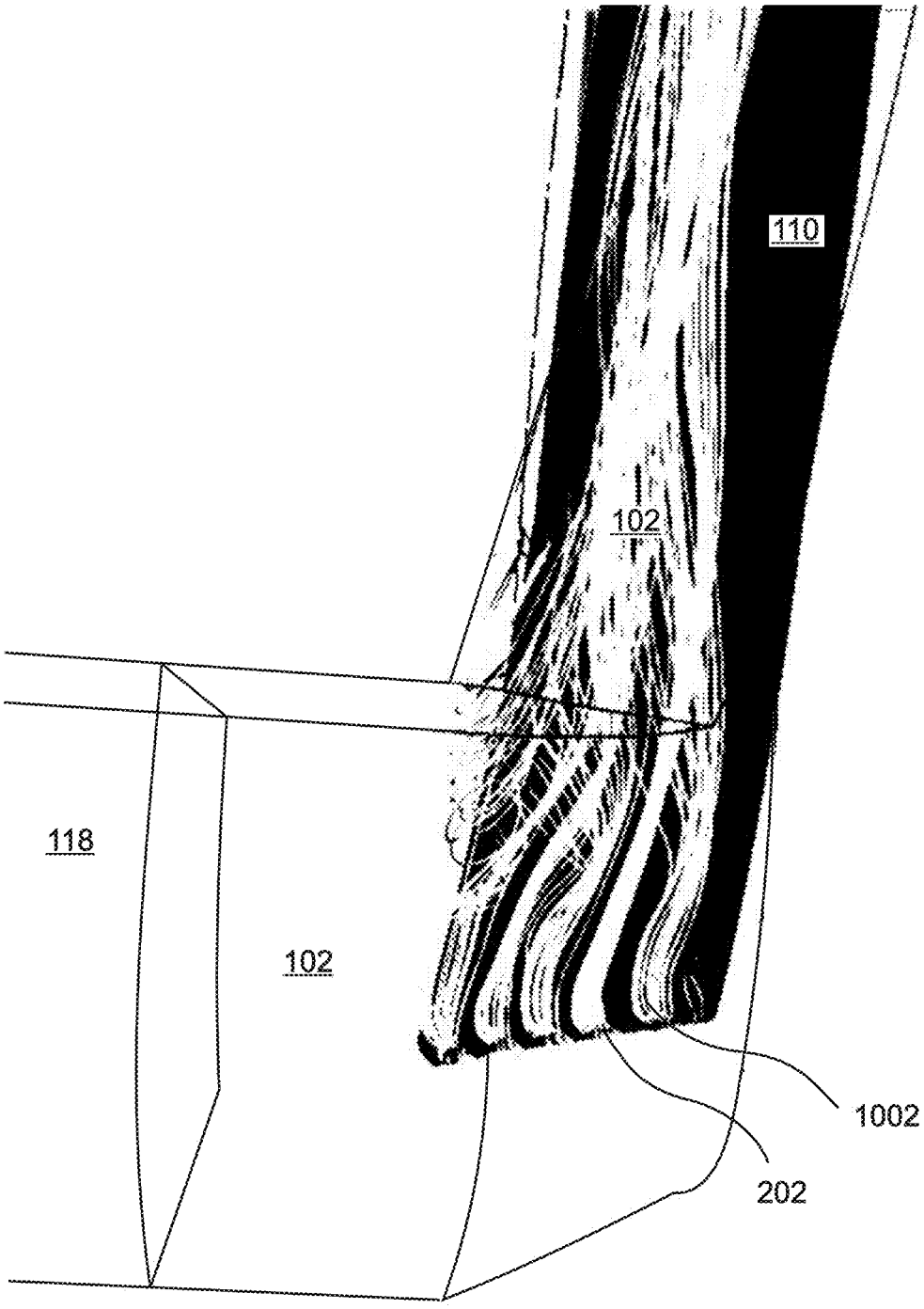
FIG. 13 is a cross-sectional view of the fluid-containing regions surrounding blades of the impellor of FIG. 12, showing simulated flow directions and velocities.

FIG. 13 is a map of process fluid flowing past a blade 110 of the impellor of FIG. 11, as calculated in a simulation. It can be seen that the entry of leakage fluid into the flow at the leading edge 202 of the blade 110 causes little if any perturbation of the flow of process fluid 102 past the blade 110.

Figure 14:
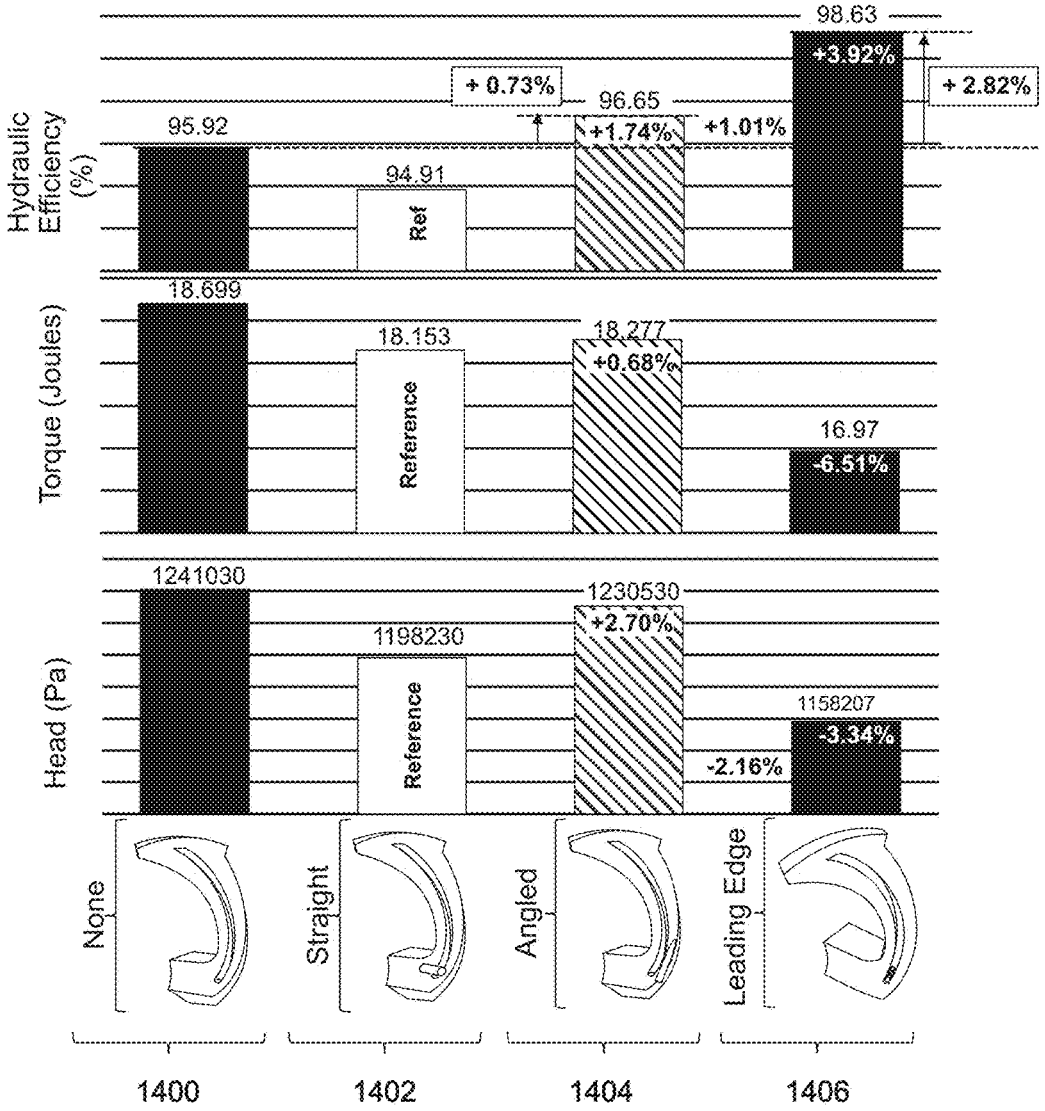
FIG. 14 is bar graph presenting performance comparisons, based on simulated data, between prior art pump designs and embodiments of the present invention.

FIG. 14 is bar graph presenting performance comparisons, based on simulated data, between prior art pump designs and embodiments of the present invention. A hypothetical impellor having no balancing holes 1400 is compared with an impellor having conventional axial balance holes 1402, an impellor of the present invention having balancing holes that direct leakage flow approximately parallel to the primary flow 1404, and an impellor 1406 that has balancing holes that exit through the leading edges of the blades.

As can be seen from the figure, in general the performance of all of the impellors 1402, 1404, 1406 that have balance holes is lower than the performance of the impellor with no balance holes 1400, although the hydraulic efficiency for the two examples of the present invention 1404, 1406 is higher than for impellor 1400 with no balancing holes. It can also be seen that the performance for the impellor with flow-aligned balancing holes 1404 consistently outperforms the impellor 1402 with conventional balancing holes.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

We claim:

1. A centrifugal pump, the centrifugal pump comprising:
- a housing;
- a drive shaft penetrating a rear wall of the housing, the drive shaft being rotatable about a central axis thereof;
- an impellor contained within the housing, the impellor comprising:
  - a substantially cylindrical central hub mounted on the drive shaft and concentric with the central axis thereof;

a rear shroud having a front surface and a rear surface, a rear cavity being formed between the housing and the rear surface of the rear shroud;

a plurality of blades symmetrically surrounding the central axis and extending outward from the central hub, the blades having rear edges fixed to the front surface of the rear shroud, the blades being configured to impart rotation to process fluid located near the rear shroud central axis, and to cause the process fluid to flow outward between the blades due to centrifugal acceleration;

at least one balancing hole, each of the balancing holes penetrating the rear shroud and continuing within a respective one of the blades, each of the balancing holes having a rear end penetrating the rear shroud and at least one front outlet penetrating a leading edge of the respective blade, each of the balancing holes being thereby configured to direct leakage fluid from the rear cavity through the front outlet in the leading edge of the respective blade;

the rear cavity being isolated from fluid communication except for the fluid communication through the at least one balancing hole and leakage of process fluid between the rear shroud and the housing;

an inlet that directs process fluid toward a central region of the rear shroud; and an outlet that collects and emits process fluid near an outer perimeter of the impellor.

2. The centrifugal pump of claim 1, wherein the impellor further comprises a front shroud attached to front edges of the blades and having a front shroud central axis that is coincident with the central axis of the drive shaft.

3. The centrifugal pump of claim 1, wherein the impellor includes a plurality of balancing holes penetrating the rear shroud, the balancing holes and the blades being equal in number, each balancing hole penetrating through a corresponding blade.

4. The centrifugal pump of claim 1, wherein the balancing hole includes a plurality of front outlets in the leading edge of the blade.

* * * * *